United States Patent [19]

Hecht

[11] Patent Number: 4,714,182

[45] Date of Patent: Dec. 22, 1987

[54] METHOD AND APPARATUS FOR MAKING BOWS

[76] Inventor: David Hecht, 14 E. 90th St., New York, N.Y. 10128

[21] Appl. No.: 7,771

[22] Filed: Jan. 28, 1987

[51] Int. Cl.[4] ..... A41H 43/00; D04D 7/10

[52] U.S. Cl. ..... 223/46; 28/147; 53/370; 53/417; 53/583

[58] Field of Search ..... 223/46; 28/147, 149, 28/150; 428/4, 5; 53/116, 370, 414, 417, 430, 583

[56] References Cited

U.S. PATENT DOCUMENTS

| | | | |
|---|---|---|---|
| 2,245,903 | 6/1941 | Cone | 223/46 UX |
| 2,521,863 | 9/1950 | Mertz | 223/46 |
| 2,666,249 | 1/1954 | Ruiz et al. | 223/46 UX |
| 3,226,908 | 1/1966 | Dudascik | 53/590 X |
| 3,286,888 | 11/1966 | Cuttler et al. | 223/46 |
| 3,591,904 | 7/1971 | Rosene | 28/147 X |
| 3,833,157 | 9/1974 | Lofton | 28/147 X |
| 4,169,346 | 10/1979 | Tange | 53/583 |
| 4,189,900 | 2/1980 | Platt, Jr. | 53/583 |
| 4,410,113 | 10/1983 | Palombo | 223/46 |

*Primary Examiner*—Robert R. Mackey

*Attorney, Agent, or Firm*—McAulay, Fields, Fisher, Goldstein & Nissen

[57] ABSTRACT

A method and apparatus for making bows comprises a tie member wrapping machine which wraps a tie member around a run of ribbon and twists it at the free ends. In order to dispose the tie at the center of the run of ribbon, a jig is mounted on the head of the wrapping machine to position the ribbon at the slot of the machine and to center the ribbon relative to the slot. The jig includes diverging rods around which the ribbon is wrapped. As the ribbon is moved rearwardly into the slot, a slack develops in the ribbon to permit a tight cinching of the central portion by the tie member.

8 Claims, 6 Drawing Figures

METHOD AND APPARATUS FOR MAKING BOWS

BACKGROUND OF THE INVENTION

The present invention relates to a method and an apparatus for making bows out of ribbon and the like.

At present, bows are manufactured by using a jig comprising a base and two horizontally spaced vertically projecting rods. A strip of material is wrapped around the rods and a piece of precut decorative cord or string is then wrapped around the center of the strip of material and tied so that the strip of material extends longitudinally on either side of the centrally placed string. The material is removed from the jig and the pieces of material on each side of the string may then be separated or fanned out to form the decorative bow.

This prior art method is very time consuming since it must be done totally by hand. The present rate for an experienced bow maker is approximately 100 pieces per hour.

SUMMARY OF THE INVENTION

The main object of the present invention is to provide a method and apparatus for making bows which will improve the rate of making the bows, without sacrificing the quality of the workmanship.

This and other objects of the present invention are achieved in accordance with the present invention wherein an automatic bag closing machine is utilized, in particular the Tie-Matic TM Mark III Model 501 machine manufactured by the Plas-Ties division of International Packaging Corporation, P.O. Box 10059, Santa Ana, Calif. This machine is well known and is at present utilized to seal the tops of plastic bags for bread or the like.

The machine is provided with a V-shaped slot that receives the top of the bag. When the machine is operated, a tie is cut off from a roll and automatically wrapped around the end of the bag. The ties comprise conventional twists, having a central wire embedded in a paper or plastic covering of the type that normally comes with plastic bags. However these ties are on an endless roll and are cut to size each time the machine is operated.

The machine operates to both sever the tie, wrap it around the end of the bag and twist it to maintain it in place.

In accordance with the present invention, a jig is mounted on the head of the machine bearing the slot and the jig includes two horizontally spaced projecting rods which are positioned on each side of the V-shaped slot, and are set at an outwardly projecting angle to the V-shaped slot.

A strip of material is wrapped around the projecting rods and the material is then moved rearwardly into the V-shaped slot. When the material reaches a preselected position in its rearward travel, a mechanism is triggered which operates the machine. A tie is then wrapped around the center of the bow by the machine and given a twist. By mounting the jig in accordance with the present invention, the tie comes out in the center of the material thereby forming the bow. By setting the rods at diverging angles to the V-shaped slot, some slack is created in the strip of material as it is moved rearwardly into the slot thereby permitting a tight cinching of the bow center, and creating a superior product compared to prior art.

By using this type of arrangement, bows can be produced at rates up to 600 bows per hour.

These and other objects and advantages of the present invention will be seen from the following detailed description of the invention taken with the drawings, wherein:

DETAILED DESCRIPTION OF THE INVENTION

Figure 1:
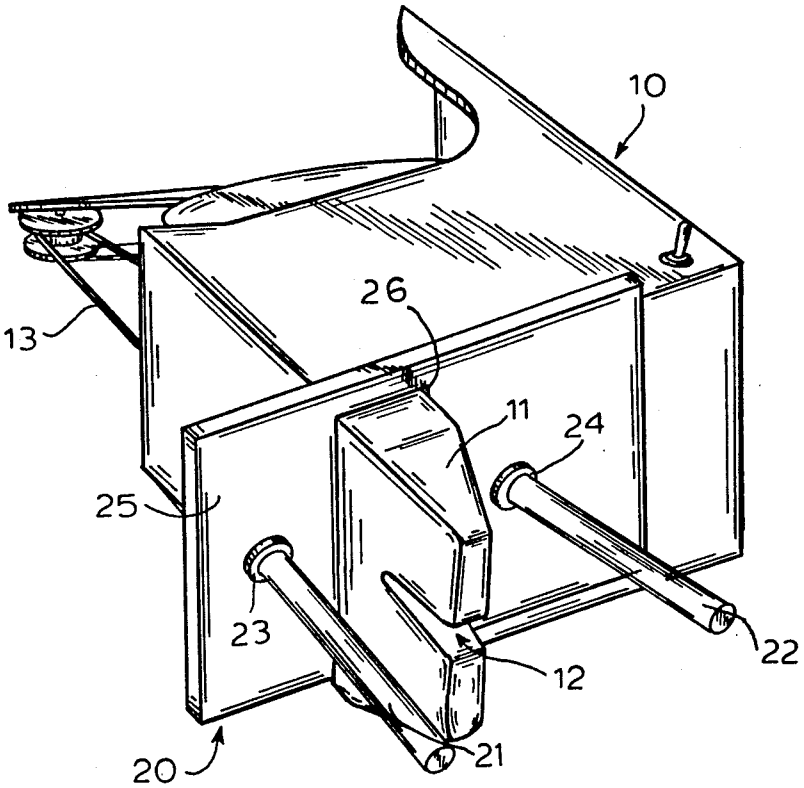
FIG. 1 is a perspective view of the apparatus used in accordance with the present invention.
Figure 5:
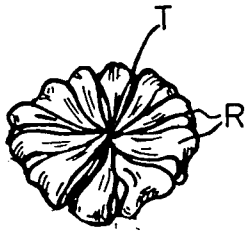
FIG. 5 shows a bow formed in accordance with the present invention.

As shown in FIG. 1, the Tie-Matic bag closing machine 10 includes a supply 13 of ties. The machine 10 includes a projecting head portion 11 having a V-shaped slot 12 in which a portion of a workpiece such as a bag is placed during use. The workpiece is inserted in to the slot 12 and, when it reaches a preselected position in its rearward travel, it triggers a mechanism which operates to wrap the tie T around the workpiece, cut the tie to a preselected length and give it a twist to maintain it in place. The workpiece is then removed from the slot 12 in the manner shown.

Additional information on the construction and operation of this machine may be obtained from the Operating and Maintenance Manual, Mark III—Tie-Matic, 8/83, published by the Plas-Ties Division, International Packaging Corporation, P.O. Box 10059, Santa Ana, Calif. 92711.

Figure 2:
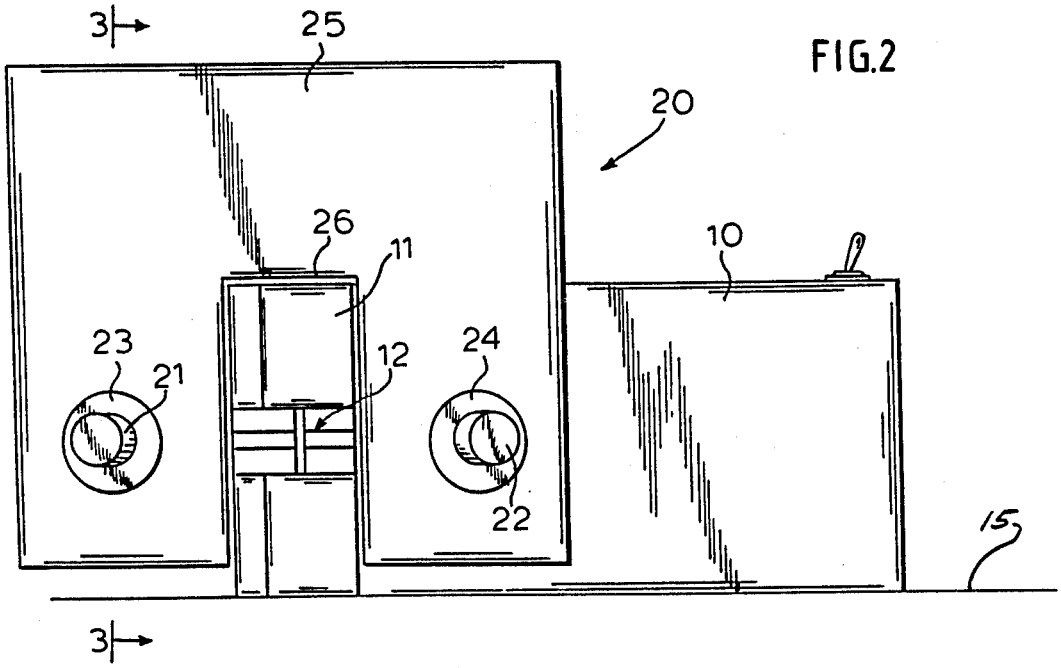
FIG. 2 is a front view of the apparatus in accordance with the present invention.

In accordance with the present invention, as shown in FIG. 2, the machine 10 is mounted on a table or flat base 15 on its side so that the head portion 11 is vertical as shown. The machine 10 can be mounted in place via a clamp or other well known fastening means.

Figure 3:
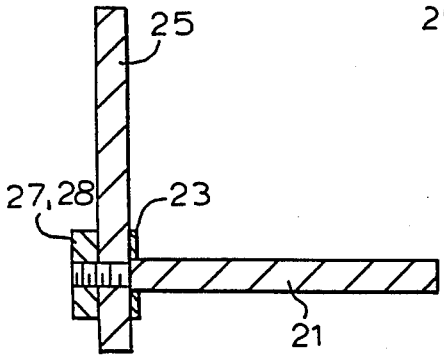
FIG. 3 is a side view of the jig shown in FIG. 2 taken along line 3—3 thereof.
Figure 4:
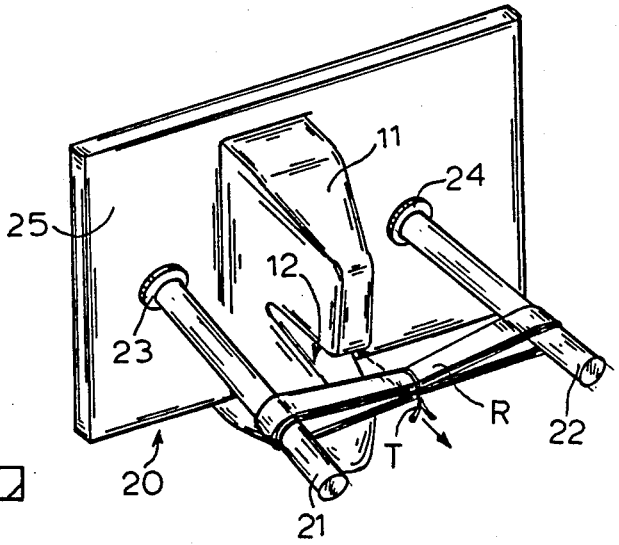
FIG. 4 is a perspective view of the jig and head of the tieing machine in accordance with the method of the present invention.

Fastened to head 11 of the machine 10 is jig 20 which includes a planar base 25 having a cutout 26 therein in which the head 11 is received. The jig 20 is oriented substantially perpendicular to the V-shaped slot 12. Jig 20 is secured to the head 11 by screws or other conventional fastening means which are not shown. Base 25 has two elongated cylindrical rods 21, 22 spaced on either side of the head 11 by an equal distance and projecting outwardly therefrom and aligned with slot 12 as shown. As can be seen from FIG. 3, posts 21 and 22 are mounted in place between flanges 23, 24 on one side of base 25 and nuts 27, 28 engageable with ends of rods 21 and 22 which are threaded. The posts or rods 21, 22 are mounted at diverging angles with respect to each other. That is, the posts are mounted so that they taper outwardly, away from each other. The rods may be set at a diverging angle of between 5° to 15° with respect to a line drawn perpendicular to the base 25 and, in a preferred embodiment, at an angle of 8°.

In use, an operator wraps a run of ribbon R around the outer ends of rods 21 and 22 and then moves the ribbon rearwardly along rods 21, 22 into the slot 12. As the ribbon moves rearwardly, a slack is created in the ribbon due to the fact that the inner ends of the rods are located closer to each other than the outer ends. At a preselected point in the rearward travel of the ribbon, the trigger mechanism causes machine 10 to be activated and tie the ribbon R with the tie T as explained hereinbefore. The tie is disposed at the central portion of the ribbon, whereby a bow can be easily formed. The tie T may be fabricated from a decorative matching paper tape with a central wire embedded therein. Moreover, the slack created in the ribbon by the angled posts permits a tight cinching of the bow center, thereby creating a superior product.

Figure 6:
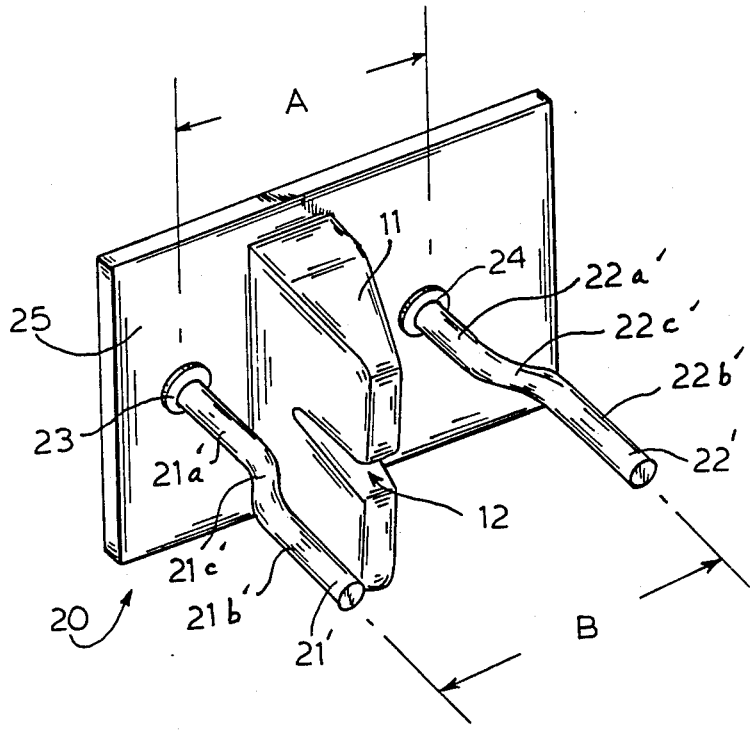
FIG. 6 is a perspective view of an alternative embodiment of the present invention.

An alternative embodiment of a bow making apparatus fabricated according to the present invention is shown in FIG. 6, wherein like reference characters indicate identical elements. However, instead of the outwardly tapering rods 21 and 22, bent rods 21' and 22' are provided. Each rod comprises a straight inner portion 21*a'*, 22*a'* spaced near the head 11 and an outer portion 21*b'*, 22*b'* spaced further away from the head 11, the respective portions of each rod being interconnected by a bent section 21*c'*, 22*c'*.

In operation, the run of a ribbon is wrapped around the outer portions 21*b'*, 22*b'* of the rods and then moved toward the base 25. The ribbon slides around bent sections 21*c'*, 22*c'* onto portions 21*a'*, 22*a'*, at which point the machine 10 operates. Since the portions 21*a'*, 22*a'* are closer to the head 11 than the portions 21*b'*, 22*b'*, a slack is created in the ribbon at the time the tie is applied to produce a tight cinching of the bow center.

The elements are sized and positioned so that the machine will not operate until the run of ribbon is on portions 21*a'*, 22*a'*. In an actual embodiment, the distance A shown in FIG. 6 was 4¼" and the distance B was 4¾" while the overall length of the rods was chosen to be 6½".

It will be appreciated that the instant specification and claims are set forth by way of illustration and not limitation, and that various modifications and changes may be made without departing from the spirit and scope of the present invention.

I claim:

1. An apparatus for making bows from ribbon comprising:

wrapping means for wrapping a tie around a plurality of layers of ribbon, said wrapping means including a head having a ribbon receiving slot therein, said head being operable to apply and wrap the tie around the plurality of layers of ribbon in response to movement of the ribbon to a predetermined point in said slot, and positioning means mounted on the head of said wrapping means, said positioning means comprising respective ribbon receiving members on each side of said head for receiving layers of ribbon thereon, first portions of said positioning means being spaced further from each other than second portions thereof, said second portions being positioned adjacent said predetermined point, whereby movement of the ribbon along said positioning means to said predetermined point produces a slack in the layers of ribbon.

2. The apparatus according to claim 1, wherein the positioning means comprises a planar base mounted perpendicular to the slot and said ribbon receiving members include two elongated rods projecting outwardly from the base and in alignment with the slot and around which a ribbon can be wrapped to position a control portion thereof in the slot, at least a portion of each rod being positioned at a greater distance from said head than another portion.

3. The apparatus of claim 2, in which each rod includes an inner portion and an outer portion spaced further away from said head than said inner portion, and a connecting section between said inner and outer portion.

4. The apparatus of claim 2, in which said rods are straight rods, and said base includes mounting means for mounting each rod at a diverging angle with respect to said head.

5. The apparatus according to claim 4, wherein the rods are positioned equidistantly from the head.

6. The apparatus according to claim 4, wherein the rods diverge outwardly away from each other at an angle between 5° and 15° to a line drawn perpendicular to said base.

7. The apparatus according to claim 6, in which the angle is 8°.

8. A method of making a bow comprising the steps of:

wrapping a ribbon around second portions of two rods each of which have first portions spaced closer to each other than second portions thereof while simultaneously positioning a central portion of the wrapped ribbon in alignment with a slot in a head of an automatic tie member wrapping and twisting apparatus;

moving the central portion of the wrapped ribbon onto the first portion of each rod and into the slot to cause a slack to develop in the central portion of the ribbon and to cause operation of the apparatus whereby a tie is wrapped around the ribbon and the free ends thereof twisted to maintain the same in place; and removing said ribbon from said rods and spreading apart the superimposed layers of the ribbon to form the bow.

* * * * *